United States Patent [19]

Aslund et al.

[11] Patent Number: 4,601,878

[45] Date of Patent: Jul. 22, 1986

[54] METHOD AND APPARATUS FOR PRODUCING MOULDED BLANKS BY HOT-PRESSING METAL POWDER

[75] Inventors: Christer Aslund, Torshälla; Torbjörn Andersson, Eskilstuna, both of Sweden

[73] Assignee: Nyby Uddeholm Powder AB, Sweden

[21] Appl. No.: 510,237

[22] Filed: Jul. 1, 1983

[30] Foreign Application Priority Data

Jul. 2, 1982 [SE] Sweden ..... 8204133

[51] Int. Cl.[4] ..... B22F 1/00; B22F 3/00

[52] U.S. Cl. ..... 419/49; 425/78

[58] Field of Search ..... 419/49

[56] References Cited

U.S. PATENT DOCUMENTS

| | | | |
|---|---|---|---|
| 3,992,200 | 11/1976 | Chandhok | 419/49 |
| 4,077,109 | 3/1978 | Larson | 419/49 |
| 4,081,272 | 3/1978 | Adlenborn | 419/49 |
| 4,094,672 | 6/1978 | Fleck et al. | 419/49 |
| 4,104,782 | 8/1978 | Veeck et al. | 419/49 |
| 4,501,718 | 2/1985 | Bradt | 419/49 |

*Primary Examiner*—Herbert S. Cockeram

*Attorney, Agent, or Firm*—Andrus, Sceales, Starke & Sawall

[57] ABSTRACT

A method and an apparatus for producing moulded blanks by hot-pressing metal powder, preferably spherical metal powder, inside a thin-walled capsule comprising an outer sleeve (2), an insertion sleeve (4) disposed approximately centerally inside the latter, a base (3) and a cover (5), inside which one separable mould (1) of solid material may be inserted. The mould (1) and the two sleeves (2, 4) are dimensioned in such a way that between the inner insertion sleeve (4) and the mould (1) there is formed a mould cavity into which the metal powder may be poured. After the metal powder is poured in, the still open capsule is subjected to a preliminary compression by means of vibration. The capsule is subsequently closed in a gas-tight manner by means of the cover (5). Then the metal powder inside the capsule is subjected to a heat-isostatic pressing at an elevated pressure and an elevated temperature of approximately 1000° to 1200° C. In this way moulding blanks with a very high degree of accuracy are obtained.

5 Claims, 3 Drawing Figures

METHOD AND APPARATUS FOR PRODUCING MOULDED BLANKS BY HOT-PRESSING METAL POWDER

DESCRIPTION

Figure 1:
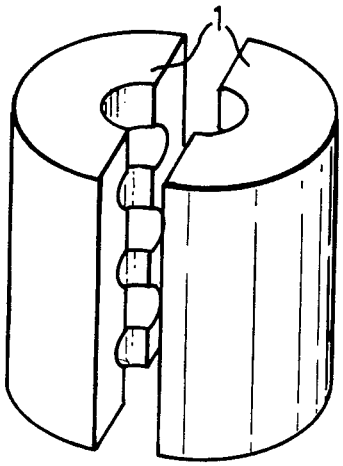

The invention relates to a method and apparatus for producing moulded blanks by hot-pressing metal powder, preferably spherical powder of iron, steel, stainless steel, nickel alloys and other metals such as titanium, aluminium or the like and their alloys, inside a thin-walled capsule of sheet steel or the like.

For this purpose metal powders are conventionally poured into a sheet metal container produced by deep drawing, untwisting or a similar method and are compressed after the container is closed. In this known method the moulded or pressed blanks respectively have considerable oversized and undersized dimensions. The tolerance uncertainty is substantial. In the case of dimensions under the norm the moulding blank is only good for scrap. In the case of dimensions over the norm an expensive, usually metal-cutting subsequent machining is required.

The object of the present invention is to change the known method and the known apparatus for performing the method in such a way that a large tolerance certainty, e.g. a high degree of accuracy is obtained in the moulded or pressed blank.

This object is attained according to the invention by a method of producing moulded blanks by hot pressing of metal powder. The metal powders preferably are a spherical powder of iron, steel, stainless steel nickel alloys and other metal such as titanium, aluminium and the like and their alloys. The powdered metal is placed within a thin walled capsule of sheet steel or the like. The capsule includes an outer sleeve and an insertion sleeve disposed coxially inside the latter. An annular base is disposed in a fluid type connection in the base region between the inner and the outer sleeves. A separable mold is introduced into the capsule in such a way that a mold cavity is formed between the mold and the inner insertion sleeve. The metal powder is poured through an opening and after filling the capsule it is subjected to vibration for purposes of a preliminary compression of the metal powder. It is subsequently closed with a cover corresponding to the base and is then subjected to a pressure on all sides and at an elevated temperature of preferably approximately 1,000 to 1,200 degrees centrigrade (heat isostatic pressing). After the metal powder has solidified to form a moulding blank. The mold and the moulding blank are removed from the capsule and the mold is separated so as to release the moulded blank.

A high degree of accuracy of the moulded blank is obtained in a surprisingly simple manner with the invention. Subsequent machining may be dispensed with.

The inner insertion sleeve preferably has the shape of a conventional tube with a cylindrical, oval, rectangular or similar cross-section. The cover and the base are of course shaped in a corresponding manner. The central inner insertion sleeve allows the outer pressure for pressing the metal powder poured into the capsule formed according to the invention to act uniformly upon the said metal powder and to force the metal powder into mould cavities and in particular radially orientated mould cavities.

The method is preferably carried out with the heating step including heating of the capsule to substantially 1,000 to 1,200 degrees centrigrade. Further, the surfaces of the separable mold which are in contact with the metal powder is also preferably provided with a thin coating of parting compound containing $Al_2O_3$. Similarly, the surfaces of the inner sleeve which are in contact with the metal powder are similarly provided with a similar thin coating of parting compound containing $Al_2O_3$. It should be additionally mentioned, however, that the mould used in the method according to the invention is preferably a separated mould of solid material, the flow limit of which is higher than the flow limit of the metal powder at the temperatures and pressures applied. The base and the cover of the capsule may likewise consist of thin sheet steel, preferably high-grade sheet steel, but the base and the cover are preferably solid annular plates with a thickness which is approximately 5 to 10 times as great as the wall thickness of the inner and outer capsule sleeves. The cover and the base are interposed between the inner and the outer capsule sleeves in a fluid-tight manner, and are preferably welded to the inner and the outer sleeves.

As already mentioned, the choice of the material of the separable mould is important for the accuracy of the moulding blank. If, for example, a mould material is used with a flow limit which at the temperature of the heat-isostatic pressing is lower than the flow limit of the powdered material to be pressed, a shrinking of the mould and in the same way dimensional inaccuracies of the moulding blank would occur. For this reason it is important that the mould should be made of a material whose flow limit at the pressing temperature of approximately 1000° to 1200° C. to be applied is substantially higher than the flow limit of the powder to be pressed. Suitable material combinations are given below:

TABLE

| Mould material | Powdered Material |
|---|---|
| stainless steel | carbon steel |
| nickel alloys | stainless steel |
| super alloys | nickel alloys such as Inconel 600 |
| ceramics | super alloys, such as Nimonic-qualities |

It has further been found that it is advantageous to provide at least the inner surfaces of the mould coming into contact with the metal powder with a thin parting compound coating, e.g. to spray them with a parting compound containing $Al_2O_3$. The parting compound coating should be sufficiently thin for the accuracy of the moulding blank not to be adversely affected thereby. The surfaces of the capsule coming into contact with the metal powder are also preferably provided with a parting compound coating of this type.

Figure 2:
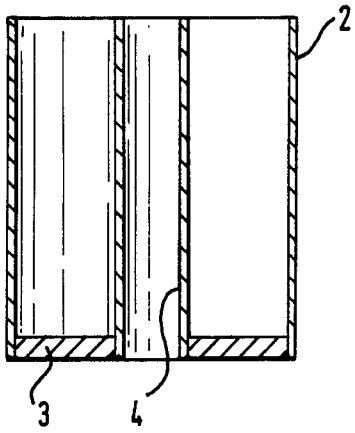
Figure 3:
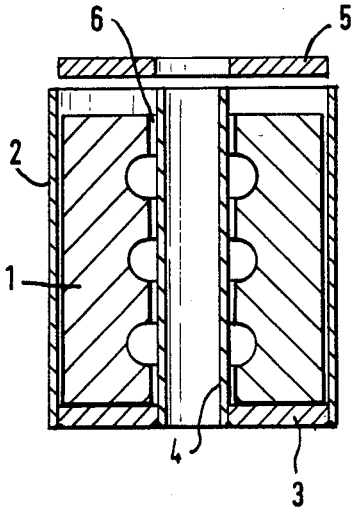

A preferred embodiment of an apparatus (capsule) according to the invention is explained in greater detail below with reference to the accompanying drawing, in which FIG. 1 is a perspective view of the separable mould;

FIG. 2 is a longitudinal section of the capsule used according to the invention for receiving the mould and metal powder, and FIG. 3 is likewise a longitudinal section of the capsule according to FIG. 2 with the mould inserted.

In the production of valve bodies for example (e.g. for ball valves) by means of a powder metallurgical method it is of crucial importance that the external dimensions of the finished product should have a very high degree of accuracy. This is achieved by the method according to the invention or by using the apparatus described in greater detail below. The latter comprises a separable mould 1 of solid material. The inner sides of the two mould halves facing one another are provided with recesses or cavities respectively corresponding to the external profile of the product to be made, e.g. a valve body. As indicated in FIG. 1, the basic shape of the two mould halves is semi-cylindrical. Before insertion into the capsule according to FIG. 2 and to be described in greater detail below, the insides of the two mould halves are provided, and preferably sprayed, with a thin coating of powdered $Al_2O_3$. The apparatus accordng to the invention further comprises a capsule consisting of an outer sleeve 2 and an insertion sleeve 4 arranged coaxially inside the latter, which are made in each case of thin sheet steel, preferably high-grade sheet steel. The internal diameter of the outer sleeve 2 is slightly greater than the outer diameter of the separable mould 1 so that the latter may be inserted into the capsule according to FIG. 2 with clearance fit. The external diameter of the inner insertion sleeve 4 is dimensioned in such a way in the example of embodiment illustrated that it is slightly less than the internal diameter of the two moulded halves so that as shown in FIG. 3 an annular gap is formed between the inner insertion sleeve 4 and the two mould halves or the mould 1 respectively, so that the mould cavities may be completely filled from above through the opening 6 in a trouble-free manner. The spacing between the inner insertion sleeve 4 and the outer sleeve 2 is effected by an annular base plate 3, which is inserted and preferably welded in a fluid-tight manner between the inner insertion sleeve 4 and the outer sleeve 2. In the still open capsule according to FIG. 2 the two semicylindrical mould havles of the mould 1 illustrated in FIG. 1 are thus inserted from above with clearance fit. The metal powder is then poured through the upper opening 6 into the free space between the inner insertion sleeve and the inside of the mould 1. After the filling a preliminary compression is carried out by vibrating the entire capsule. Thereafter the capsule is closed in a gas-tight manner by an annular cover 5 corresponding to the base 3. The cover 5 is preferably welded in between the inner insertion sleeve 4 and the outer sleeve 2. The mould is then subjected to an isostatic pressure and a temperature of approximately 1000° to 1200° C. The pressure and temperature essentially depend upon the nature of the metal powder to be pressed.

After the heat-isostatic pressing the mould together with the moulding blank is removed from the capsule. The moulding blank is released simply by removing the two mould halves. The capsule and the two mould halves may where appropriate be used for renewed moulding pressing. In the case of the example of embodiment according to FIGS. 2 and 3 the base and the cover consist in each case of annular plates of a thickness which is approximately 5 times as great as the wall thickness of the inner or outer sleeve 4 and 2 respectively. The annular plates 3 and 5 thus contribute to the increase in stability of the capsule.

By virtue of the method according to the invention and the apparatus according to the invention production may be performed considerably more cheaply than in the known art, inter alia by a very low consumption of starting material and the absence of or only insignificant subsequent machining of the moulding blank. In addition, the invention is characterized by a high reproducibility of tolerance minima and the lack of waste. Moulded blanks under the norm are avoided.

We claim:

1. A method of producing moulded blanks by hot-pressing metal powder within a thin-walled capsule of a sheet metal and incuding an outer sleeve (2) and an inner insertion sleeve (4) disposed coaxially inside the outer sleeve and having a first end of the sleeve sealed with an approximately annular closure base (3) disposed in a fluid-tight connection to said inner sleeve (4) and said outer sleeve (2) and having a second open end, comprising inserting a separable mould (1) into said capsule with the mould spaced from the inner insertion sleeve (4) to define a mould cavity, inserting metal powder into the cavity from the second open end (6) of said capsule, vibrating the capsule to compress said inserted metal powder, sealing the second open end of the capsule, isostatic pressurizing all sides of said capsules, simultaneously heating said capsule to an elevated temperature to create a hot-isostatic pressing of said metal powder, and removing said separable mould and moulded blank from said capsule after said metal powder has solidified to form said moulded blank.

2. The method of claim 1 wherein said heating step includes heating said capsule to substantially 1000 to 1200 C.

3. The method according to claim 1, wherein said separable mould is formed of a metal having a higher flow limit than said metal powder under the conditions of said heat-isostatic compressing.

4. The method according to claim 1 wherein surfaces of said separable mould (1) in contact with said metal powder includes a thin coating of a parting compound containing $Al_2O_3$.

5. The method of claim 4 wherein surfaces of said inner sleeve (4) in contact with said metal powder include a thin coating of a parting compound containing $Al_2O_3$.

* * * * *